US008329367B2

(12) United States Patent
Wu et al.

(10) Patent No.: US 8,329,367 B2
(45) Date of Patent: Dec. 11, 2012

(54) POLYAMIDEIMIDE CONTAINING PHOTOCONDUCTORS

(75) Inventors: Jin Wu, Pittsford, NY (US); Yuhua Tong, Webster, NY (US); Linda L Ferrarese, Rochester, NY (US); Edward C Savage, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 484 days.

(21) Appl. No.: 12/695,420

(22) Filed: Jan. 28, 2010

(65) Prior Publication Data

US 2011/0183245 A1 Jul. 28, 2011

(51) Int. Cl.
*G03G 5/05* (2006.01)
*G03G 5/047* (2006.01)

(52) U.S. Cl. ..... 430/59.6; 430/58.8; 430/58.75; 430/60

(58) Field of Classification Search ..... 430/58.8, 430/58.75, 59.6, 60, 96, 59.4
See application file for complete search history.

(56) References Cited

U.S. PATENT DOCUMENTS

| | | | | |
|---|---|---|---|---|
| 4,265,990 | A | 5/1981 | Stolka et al. | |
| 4,921,773 | A * | 5/1990 | Melnyk et al. | 430/132 |
| 2006/0257767 | A1* | 11/2006 | Tong et al. | 430/58.8 |
| 2008/0057424 | A1* | 3/2008 | Tong et al. | 430/58.7 |

FOREIGN PATENT DOCUMENTS

JP 63274960 A * 11/1988

OTHER PUBLICATIONS

English language translation of JP 63-274960 (Nov. 1998).*
Jin Wu et al., U.S. Appl. No. 12/550,498 on Plasticizer Containing Photoconductors, filed Aug. 31, 2009.
Robert C.U. Yu et al., U.S. Appl. No. 12/471,311 on Flexible Imaging Members Having a Plasticized Imaging Layer, filed May 22, 2009.
Robert C.U. Yu et al., U.S. Appl. No. 12/434,572 on Flexible Imaging Members Without Anticurl Layer, filed May 1, 2009.
Robert C.U. Yu et al., U.S. Appl. No. 12/551,414 on Flexible Imaging Member Belts, filed Aug. 31, 2009.
Robert C.U. Yu et al., U.S. Appl. No. 12/551,440 on Flexible Imaging Member Belts, filed Aug. 31, 2009.
Jin Wu, U.S. Appl. No. 12/644,112 on Sulfonamide Containing Photoconductors, filed Dec. 22, 2009.

* cited by examiner

*Primary Examiner* — Christopher Rodee
(74) *Attorney, Agent, or Firm* — Eugene O. Palazzo

(57) ABSTRACT

A photoconductor that includes a supporting substrate, an optional ground plane layer, an optional hole blocking layer, a photogenerating layer, and at least one charge transport layer, and where the charge transport layer contains a polyamideimide.

34 Claims, No Drawings

POLYAMIDEIMIDE CONTAINING PHOTOCONDUCTORS

CROSS REFERENCE TO RELATED APPLICATIONS

U.S. application Ser. No. 12/550,498 filed Aug. 31, 2009 illustrates a photoconductor comprising a substrate, a photogenerating layer, and a charge transport layer, and wherein the charge transport layer contains a cyclohexanedicarboxylate, such as diisononyl cyclohexanedicarboxylate.

U.S. application Ser. No. 12/471,311, filed May 22, 2009, illustrates a flexible imaging member comprising a flexible substrate; a charge generating layer disposed on the substrate; and at least one charge transport layer disposed on the charge generating layer, wherein the charge transport layer comprises a polycarbonate, N,N'-diphenyl-N,N'-di(3-methylphenyl)-1,1-biphenyl-4,4'-diamine, a first plasticizer or a second plasticizer, and further wherein the first plasticizer and the second plasticizer are miscible with both the polycarbonate and N,N'-diphenyl-N,N'-di(3-methylphenyl)-1,1-biphenyl-4,4'-diamine.

U.S. application Ser. No. 12/434,572, filed May 1, 2009, illustrates a imaging member comprising a substrate; a charge generating layer disposed on the substrate; and at least one charge transport layer disposed on the charge generating layer, wherein the charge transport layer comprises a polycarbonate, a charge transport compound of N,N'-diphenyl-N,N'-bis(3-methylphenyl)-1,1-biphenyl-4,4'-diamine, and a liquid compound having a high boiling point, and further wherein the liquid compound is miscible with both the polycarbonate and N,N'-diphenyl-N,N'-bis(3-methylphenyl)-1,1-biphenyl-4,4'-diamine.

Examples of plasticizers illustrated in the above copending applications are, for example, dioctyl phthalate, diallyl phthalate, liquid styrene dimer, and others as illustrated by the structure/formulas disclosed.

Illustrated in copending U.S. application Ser. No. 12/644,112, filed Dec. 22, 2009, is a photoconductor comprising a substrate, a photogenerating layer, and a charge transport layer, and wherein the charge transport layer contains a sulfonamide additive.

Illustrated in copending U.S. application Ser. No. 12/551,414, filed Aug. 31, 2009, is a flexible imaging member comprising a flexible substrate; a charge generating layer disposed on the substrate; and at least one charge transport layer disposed on the charge generating layer, wherein the charge transport layer is formed from a binary solid solution comprises a charge transport component and a polycarbonate binder plasticized with a plasticizer mixture consisting of a phthalate plasticizing liquid and a plasticizer compound and further wherein the flexible imaging member does not include an anticurl back coating layer.

Illustrated in copending U.S. application Ser. No. 12/551,440, filed Aug. 31, 2009, is a layered photoconductor that includes a charge transport layer generated with a polycarbonate plasticized with a number of materials of Formulas (I) to (VII) and Formulas (1) to (5).

High photosensitivity titanyl phthalocyanines are illustrated in copending U.S. application Ser. No. 10/992,500, U.S. Publication No. 20060105254, the disclosure of which are totally incorporated herein by reference, which, for example, discloses a process for the preparation of a Type V titanyl phthalocyanine, comprising providing a Type I titanyl phthalocyanine; dissolving the Type I titanyl phthalocyanine in a solution comprising a trihaloacetic acid and an alkylene halide like methylene chloride; adding the resulting mixture comprising the dissolved Type I titanyl phthalocyanine to a solution comprising an alcohol and an alkylene halide thereby precipitating a Type Y titanyl phthalocyanine; and treating the Type Y titanyl phthalocyanine with monochlorobenzene to yield a Type V titanyl phthalocyanine.

A number of the components of the above cross referenced applications, such as the supporting substrates, resin binders, antioxidants, charge transport components, titanyl phthalocyanines, high photosensitivity titanyl phthalocyanines, such as Type V, hydroxygallium phthalocyanines, adhesive layers, and the like, may be selected for the photoconductors and imaging members of the present disclosure in embodiments thereof.

BACKGROUND

This disclosure is generally directed to layered imaging members, photoreceptors, photoconductors, and the like that can be selected for a number of systems, such as copiers and printers, especially xerographic copiers and printers, inclusive of printers that generate color xerographic documents, and which printers can be selected for the office environment, and for production and commercial uses. More specifically, the present disclosure is directed to multilayered drum, or flexible, belt imaging members or devices comprised of a supporting medium like a substrate; an optional ground plane layer, an optional hole blocking layer; a photogenerating layer; and a charge transport layer, including at least one or a plurality of charge transport layers, and wherein at least one charge transport layer is, for example, from 1 to about 7, from 1 to about 3, and one; and more specifically, a first charge transport layer and a second charge transport layer, and where a polyamideimide and yet more specifically, a polyamideimide that contains an amide segment and an imide segment, especially in embodiments where the polyamideimide is present in a first pass charge transport layer that is in contact with the photogenerating layer. The polyamideimide containing photoconductors possess, in embodiments, excellent wear characteristics and where the polyamideimide functions, for example, as a binder for the charge transport layer components.

The photoconductors disclosed herein possess a number of advantages, such as, in embodiments, the minimal wearing of the charge transport layer or layers; the minimization or substantial elimination of undesirable ghosting on developed images, such as xerographic images, including decreased ghosting at various relative humidities; excellent cyclic and stable electrical properties; minimal charge deficient spots (CDS); compatibility with the photogenerating and charge transport resin binders; and acceptable lateral charge migration (LCM) characteristics, such as for example, excellent LCM resistance.

Ghosting refers, for example, to when a photoconductor is selectively exposed to positive charges in a number of xerographic print engines, and where some of the positive charges enter the photoconductor and manifest themselves as a latent image in the subsequent printing cycles. This print defect can cause a change in the lightness of the half tones, and is commonly referred to as a "ghost" that is generated in the previous printing cycle. An example of a source of the positive charges is the stream of positive ions emitted from the transfer corotron. Since the paper sheets are situated between the transfer corotron and the photoconductor, the photoconductor is shielded from the positive ions from the paper sheets. In the areas between the paper sheets, the photoconductor is fully exposed, thus in this paper free zone the positive charges may enter the photoconductor. As a result, these charges cause a print defect or ghost in a half tone print if one switches to a larger paper format that covers the previous paper print free zone.

Excellent cyclic stability of the photoconductor refers, for example, to almost no or minimal change in a generated known photoinduced discharge curve (PIDC), especially no or minimal residual potential cycle up after a number of charge/discharge cycles of the photoconductor, for example about 100 kilocycles, or xerographic prints of, for example, from about 80 to about 100 kiloprints. Excellent color print stability refers, for example, to substantially no or minimal change in solid area density, especially in 60 percent halftone prints, and no or minimal random color variability from print to print after a number of xerographic prints, for example 50 kiloprints.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital and/or color printing, are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

There is illustrated in U.S. Pat. No. 6,913,863, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, wherein there is illustrated an imaging member comprised of a photogenerating layer, and a hole transport layer.

Illustrated in U.S. Pat. No. 5,521,306 is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811 is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064 there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, hydrolyzing said pigment precursor chlorogallium phthalocyanine Type I by standard methods, for example acid pasting, subsequently treating the resulting hydrolyzed pigment hydroxygallium phthalocyanine Type I with a solvent, such as N,N-dimethylformamide, present in an amount of from about 1 to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 to 5 millimeters in diameter, at room temperature, about 25° C., for a period of from about 12 hours to about 1 week, and more specifically about 24 hours.

The appropriate components, such as the supporting substrates, the photogenerating layer components, the charge transport layer components, the overcoating layer components, and the like of the above-recited patents may be selected for the photoconductors of the present disclosure in embodiments thereof.

EMBODIMENTS

There is disclosed a photoconductor comprising a substrate, a photogenerating layer, and a charge transport layer, and wherein the charge transport layer contains a polyamideimide; a photoconductor comprising a substrate, an optional undercoat layer thereover, a photogenerating layer, and at least charge transport layer, and wherein the charge transport layer is in contact with the photogenerating layer and which at least one charge transport layer contains a polyamideimide present in an amount of, for example, from about 0.1 to about 25 weight percent, and wherein at least one charge transport layer is 1, 2, or 3 layers; a photoconductor comprised in sequence of a photogenerating layer comprised of a photogenerating pigment and a charge transport layer, and wherein the charge transport layer is comprised of a charge transport component and a polyamideimide present in an amount of from about 0.1 to about 25 weight percent, and wherein the polyamideimide is represented by

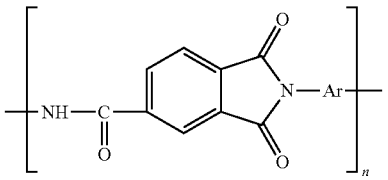

wherein Ar is aryl with from 6 to about 36 carbon atoms, and n represents the number of repeating units and is a number of, for example, from about 20 to about 1,000, from about 50 to about 700, from about 100 to about 500, from about 25 to about 75; a photoconductor wherein the polyamideimide is represented by

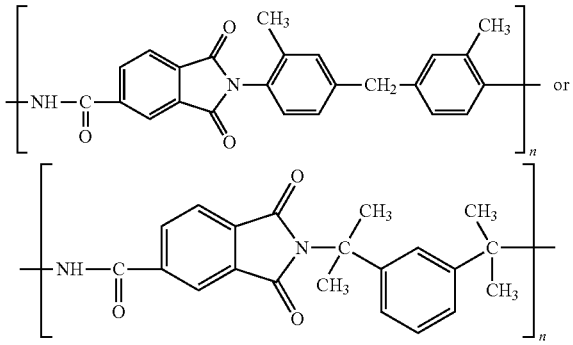

and wherein n represents a number of from about 40 to about 500; a photoconductor further including a silicone containing polyamideimide; a photoconductor wherein the silicone containing polyamideimide is represented by

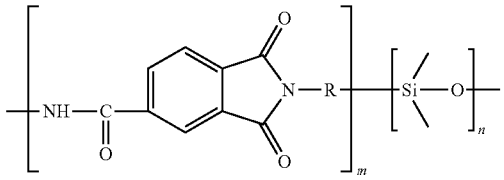

wherein R is alkyl, aryl, or mixtures thereof; m and n represent the number of segments, and where the sum of m plus n is, for example, from about 10 to about 1,000, from about 75 to about 700, from about 125 to about 500, from about 150 to about 300; a photoconductor wherein m is from about 5 to about 500, n is from about 2 to about 500, $M_w$ is from about 3,000 to about 50,000, $M_n$ is from about 1,000 to about 20,000 with $M_w$ and $M_n$ being determined by known methods such as GPC; R is alkyl with from 1 to about 6 carbon atoms, and the silicone containing polyamideimide has a glass transition temperature of from about 255° C. to about 325° C.; a photoconductor comprising a substrate, a photogenerating layer, and a charge transport layer, and wherein the charge transport layer contains a polyamideimide; a photoconductor comprising a substrate, an undercoat layer thereover, a photogenerating layer, and at least one charge transport layer, and wherein the at least one charge transport layer in contact with the photogenerating layer contains a polyamideimide present in an amount of from about 0.1 to about 30 weight percent, from 1 to about 20 weight percent, from 2 to about 10 weight percent, more specifically about 1, 2, 3 or 4, and yet more specifically, about 2 weight percent; a photoconductor comprised in sequence of a photogenerating layer comprised of a photogenerating pigment, and a charge transport layer, and wherein the transport layer is comprised of a charge transport component and a polyamideimide with a suitable glass transition temperature of, for example, from about 200° C. to about 400° C., from about 220° C. to about 350° C., and from about 240° C. to about 300° C. determined by Differential Scanning calorimetry (DSC); a photoconductor comprising a supporting substrate, a ground plane layer, a hole blocking layer, a photogenerating layer comprised of at least one photogenerating pigment, and at least one charge transport layer comprised of at least one charge transport component, and where the charge transport layer has incorporated therein a polyamideimide available from Toyobo America, Inc., New York, N.Y.; a flexible photoconductive member comprised in sequence of a supporting substrate, a ground plane layer, a hole blocking or undercoat layer, a photogenerating layer thereover comprised of at least one photogenerating pigment, and a polyamideimide containing charge transport layer; a photoconductor which includes a hole blocking layer and an adhesive layer where the adhesive layer is situated between the hole blocking layer and the photogenerating layer, and the hole blocking layer is situated between the supporting substrate layer, and the adhesive layer; a photoconductor comprising a supporting substrate, a hole blocking layer, a photogenerating layer, and at least one charge transport layer comprised of at least one charge transport component, and wherein the first pass charge transport layer is in contact with the photogenerating layer, the second pass charge transport layer is in contact with the first charge transport layer, and the second pass charge transport layer includes therein a polyamideimide, a hole transport component, and a resin binder; a photoconductor comprising a supporting substrate, a photogenerating layer in contact with the supporting substrate, and at least one charge transport layer in contact with the photogenerating layer, and wherein at least one, such as 1, 2, or 3 charge transport layers, contains a polyamideimide as illustrated herein; a photoconductor comprised in sequence of a photogenerating layer comprised of a photogenerating pigment, such as a hydroxygallium phthalocyanine or a titanyl phthalocyanine, a first charge transport layer, and a second charge transport layer thereover, and wherein the second charge transport layer is comprised of a charge transport component and a polyamideimide as represented by or encompassed by

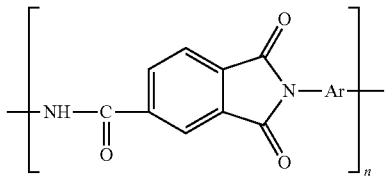

wherein n represents the number of repeating units, and Ar represents aryl with, for example, from 6 to about 42 carbons. More specifically, n can be a number of from about 20 to about 1,000, from about 40 to about 750, and from about 80 to about 500, and where the polyamideimide weight average molecular weight is, for example, from about 5,000 to about 200,000, or from about 10,000 to about 100,000, and the polyamideimide number average molecular weight is, for example, from about 2,000 to about 40,000, or from about 4,000 to about 20,000, and wherein the weight and number average molecular weights, $M_w$ and $M_n$ respectively, are determined by Gel Permeation Chromatography (GPC) analysis.

Examples of polyamideimides that can be included in the charge transport layer or layers primarily to provide for excellent wear resistant properties are VYLOMAX® HR-15ET ($M_w$=10,000 and $T_g$=260° C.), HR-11NN ($M_w$=45,000 and $T_g$=300° C.), HR-12N2 ($M_w$=8,000 and $T_g$=255° C.), HR-13NX ($M_w$=10,000 and $T_g$=280° C.), HR-16NN ($M_w$=100,000 and $T_g$=320° C.), all available from Toyobo America, Inc., New York, N.Y.

In embodiments, the selected charge transport layer polyamideimides (PAI) can be synthesized by the known reactions (1) the isocyanate method which involves a reaction of an isocyanate and a trimellitic anhydride; or (2) the acid chloride method, which involves the reaction of a diamine and a trimellitic anhydride chloride.

PHOTOCONDUCTOR LAYER EXAMPLES

A number of known components can be selected for the various photoconductor layers, such as the supporting substrate, the photogenerating layer, the charge transport layer, the hole blocking layer when present, and the adhesive layer when present, such as those components as illustrated in the copending applications referenced herein.

The thickness of the photoconductor substrate layer depends on many factors, including economical considerations, electrical characteristics, adequate flexibility, availability, and cost of the specific components for each layer, and the like, thus this layer may be of a substantial thickness, for example about 3,000 microns, such as from about 1,000 to about 2,000 microns, from about 500 to about 1,000 microns, or from about 300 to about 700 microns ("about" throughout includes all values in between the values recited), or of a minimum thickness. In embodiments, the thickness of this layer is from about 75 to about 300 microns, or from about 100 to about 150 microns.

The photoconductor substrate may be opaque or substantially transparent, and may comprise any suitable material including known or future developed materials. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, gold, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired, and economical considerations. For a drum, this layer may be of a substantial thickness of, for example, up to many centimeters or of a minimum thickness of less than a millimeter. Similarly, a flexible belt may be of a substantial thickness of, for example, about 250 microns, or of a minimum thickness of less than about 50 microns provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the photoconductors of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Examples of electrically conductive layers or ground plane layers usually present on nonconductive substrates are gold, gold containing compounds, aluminum, titanium, titanium/zirconium, and other known suitable know components. The thickness of the metallic ground plane is, for example, from about 10 to about 100 nanometers, from about 20 to about 50 nanometers, and more specifically, about 35 nanometers, and the titanium or titanium/zirconium ground plane is, for example, from about 10 to about 30 nanometers, and more specifically, about 20 nanometers in thickness.

An optional hole blocking layer when present is usually in contact with the ground plane, and can be comprised of a number of known components as illustrated herein, such as metal oxides, phenolic resins, aminosilanes, mixtures thereof, and the like.

Aminosilane examples included in the hole blocking layer can be represented by

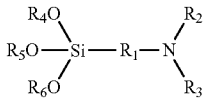

wherein $R_1$ is an alkylene group containing, for example, from 1 to about 25 carbon atoms; $R_2$ and $R_3$ are independently selected from the group consisting of at least one of hydrogen or alkyl containing, for example, from 1 to about 12 carbon atoms, and more specifically, from 1 to about 4 carbon atoms; aryl with, for example, from about 6 to about 42 carbon atoms, such as a phenyl group; and a poly(alkylene like ethylene amino) group; and $R_4$, $R_5$ and $R_6$ are independently selected from an alkyl group containing, for example, from 1 to about 10 carbon atoms, and more specifically, from 1 to about 4 carbon atoms.

Aminosilane specific examples include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and the like, and mixtures thereof. Yet more specific aminosilane materials are 3-aminopropyl triethoxysilane (γ-APS), N-aminoethyl-3-aminopropyl trimethoxysilane, (N,N'-dimethyl-3-amino)propyl triethoxysilane, and mixtures thereof.

The aminosilane may be hydrolyzed to form a hydrolyzed silane solution before being added into the final undercoat coating solution or dispersion. During hydrolysis of the aminosilanes, the hydrolyzable groups, such as alkoxy groups, are replaced with hydroxyl groups. The pH of the hydrolyzed silane solution can be controlled to obtain excellent characteristics on curing, and to result in electrical stability. A solution pH of, for example, from about 4 to about 10 can be selected, and more specifically, a pH of from about 7 to about 8. Control of the pH of the hydrolyzed silane solution may be affected with any suitable material, such as generally organic or inorganic acids. Typical organic and inorganic acids include acetic acid, citric acid, formic acid, hydrogen iodide, phosphoric acid, hydrofluorosilicic acid, p-toluene sulfonic acid, and the like.

The hole blocking layer can, in embodiments, be prepared by a number of known methods, the process parameters being dependent, for example, on the photoconductor member desired. The hole blocking layer can be coated as a solution or a dispersion onto the supporting substrate or on to the ground plane layer by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 1 minute to about 10 hours, under stationary conditions or in an air flow. The coating can be accomplished to provide a final coating thickness of, for example, from about 0.01 to about 30 microns, from about 0.02 to about 5 microns, or from about 0.03 to about 0.5 micron after drying.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, high sensitivity titanyl phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer, in embodiments, is dependent primarily upon factors, such as photosensitivity, electrical properties, and mechanical considerations.

The photogenerating composition or pigment can be present in a resinous binder composition in various amounts inclusive of up to 100 percent by weight. Generally, however, from about 5 to about 95 percent by volume of the photogenerating pigment is dispersed in about 95 to about 5 percent by volume of the resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly (vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon and germanium, carbon, oxygen, nitrogen, and the like fabricated by vacuum evaporation or deposition. The photogenerating layer may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder, and fabricated by solvent coating techniques.

In embodiments, examples of polymeric binder materials that can be selected as the matrix or binder for the photogenerating layer are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 10 microns, or from about 0.2 to about 2 microns can be applied to or deposited on a supporting substrate, or on other surfaces in between the substrate and the charge transport layer, and the like. A charge blocking layer or hole blocking layer may optionally be applied to the electrically conductive supporting substrate surface prior to the application of a photogenerating layer. When desired, an adhesive layer may be included between the charge blocking, hole blocking layer or interfacial layer, and the photogenerating layer. Usually, the photogenerating layer is applied onto the blocking layer, and a charge transport layer or plurality of charge transport layers is formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary, and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer or layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

A number of charge transport compounds can be included in the charge transport layer, which layer generally is of a thickness of from about 5 to about 75 microns, and more specifically, of a thickness of from about 10 to about 40 microns. Examples of charge transport components are aryl amines of the following formulas/structures

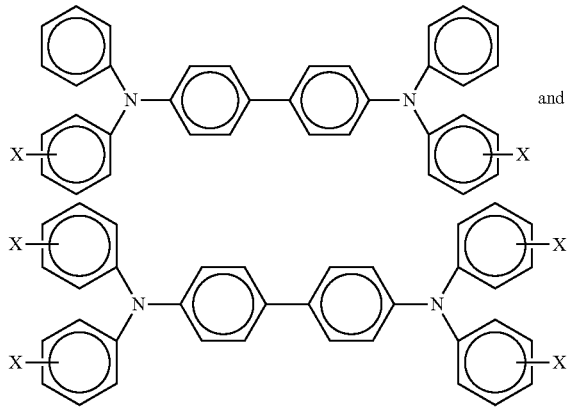

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

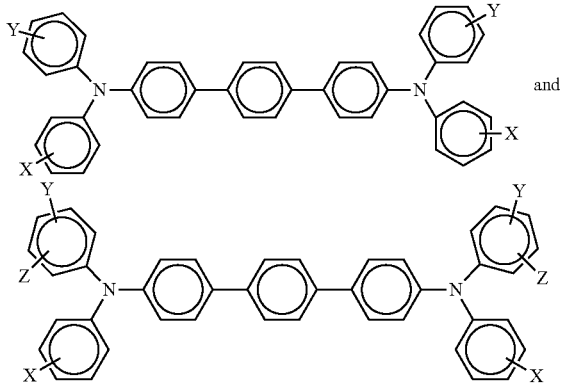

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like, N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)N,N'-di-m-tolyl-[terphenyl]-4,4'-diamine. N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3chlorophenyl)[terphenyl]-4,4'-diamine, and the like. Other known charge transport layer molecules can be selected, reference for example, U.S. Pat. Nos. 4,921,773 and 4,464,450, the disclosures of which are totally incorporated herein by reference.

Examples of binder materials in addition to the compatible polyamideimide selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene) carbonate (also referred to as bisphenol-A-polycarbonate), poly(4,4'-cyclohexylidine diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer, may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules present, for example, in an amount of from about 50 to about 75 weight percent, include for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)[p-terphenyl]-4,4'-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N, N'-bis(3-chlorophenyl)-[p-terphenyl]-4,4'-diamine, or mixtures thereof. If desired, the charge transport material in the charge transport layer may comprise a polymeric charge transport material, or a combination of a small molecule charge transport material and a polymeric charge transport material.

Examples of components or materials optionally incorporated into the charge transport layers, or at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to selectively discharge a surface charge present on the surface of the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. A known optional overcoating may be applied over the charge transport layer to provide abrasion protection.

In embodiments the present disclosure relates to a photoconductive imaging member comprised of a titanium/zirconium containing ground plane layer, a hole blocking layer, a photogenerating layer, a polyamideimide containing charge transport layer, and an overcoating charge transport layer; a photoconductive member with a photogenerating layer of a thickness of from about 0.1 to about 8 microns, and at least one transport layer each of a thickness of from about 5 to about 100 microns; an imaging method and an imaging apparatus containing a charging component, a development component, a transfer component, and a fixing component, and wherein the apparatus contains a photoconductive imaging member comprised of a supporting substrate, a ground plane layer, a hole blocking layer, and thereover a photogenerating layer comprised of a photogenerating pigment, and a charge transport layer or layers, and thereover an overcoating charge transport layer, and where the transport layer is of a thickness of from about 40 to about 75 microns; a member wherein the photogenerating layer contains a photogenerating pigment present in an amount of from about 8 to about 95 weight percent; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a titanyl phthalocyanine or a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate, aluminized polyethylene naphthalate, titanized polyethylene terephthalate, titanized polyethylene naphthalate, titanized/zirconized polyethylene terephthalate, titanized/zirconized polyethylene naphthalate, goldized polyethylene terephthalate, or goldized polyethylene naphthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers comprises

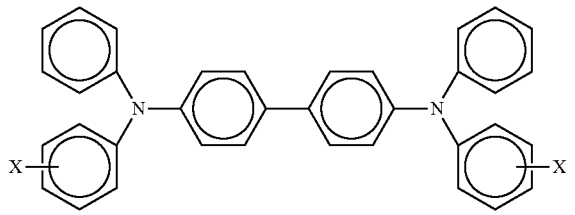

wherein X is selected from the group consisting of alkyl, alkoxy, aryl, and halogen; an imaging member wherein alkyl and alkoxy contains from about 1 to about 12 carbon atoms; an imaging member wherein alkyl contains from about 1 to about 5 carbon atoms; an imaging member wherein alkyl is methyl: an imaging member wherein each of, or at least one of the charge transport layers comprises

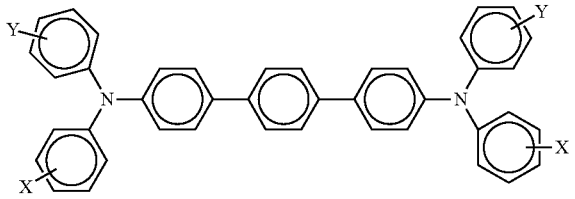

wherein X and Y are independently alkyl, alkoxy, aryl, a halogen, or mixtures thereof; an imaging member wherein alkyl and alkoxy for the charge transport component aryl amine contain from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees: a method of imaging which comprises generating an electrostatic latent image on an imaging member developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the charge transport: a member wherein the charge transport layer is situated between the substrate and the photogenerating layer; a member wherein the photogenerating layer is of a thickness of from about 0.1 to about 50 microns; a member wherein the photogenerating pigment is dispersed in from about 1 weight percent to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, Type V titanyl phthalocyanine or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine. N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N, N'-bis-(4-isopropylphenyl)-[p-terphenyl]-4,4'-diamine, N,N'-bis(4-butylphenyl)-N, N'-bis-(2-ethyl-6-methylphenl)-[p-terphenyl]-4,4'-diamine. N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine molecules, and wherein the hole transport resinous binder is selected from the group consisting of polycarbonates and polystyrene; an imaging member wherein the photogenerating layer contains a metal free phthalocyanine: a photoconductor wherein the photogenerating layer contains an alkoxygallium phthalocyanine; photoconductive imaging members comprised of a supporting substrate, a photogenerating layer, a hole transport layer, and in embodiments wherein a plurality of charge transport layers are selected, such as for example, from two to about ten, and more specifically two may be selected; and a photoconductive imaging member comprised of an optional supporting substrate, a photogenerating layer, and a first, second, and third charge transport layer.

In embodiments, the charge transport component can be represented by the following formulas/structures

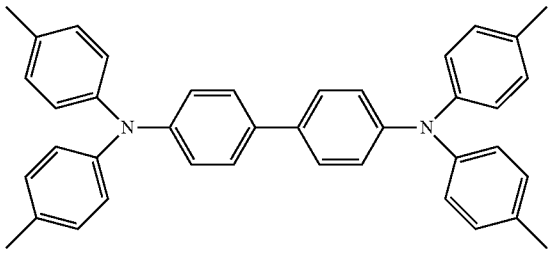

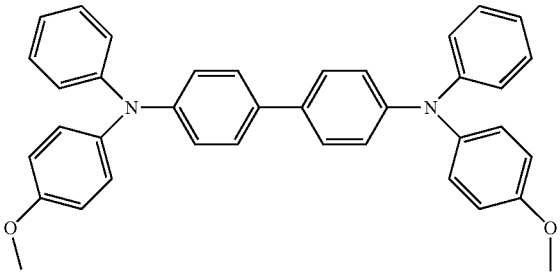

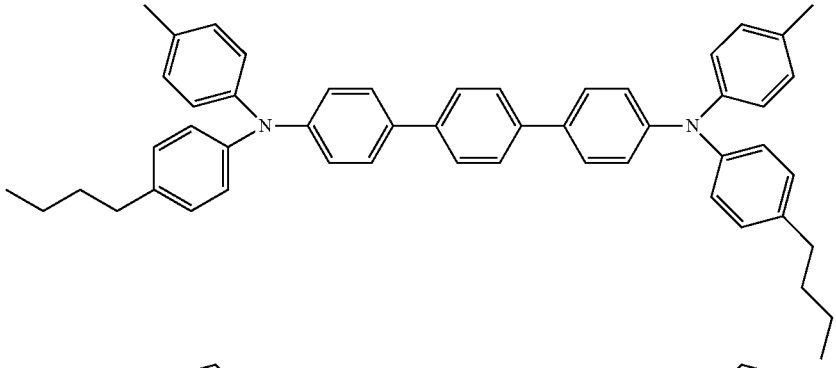

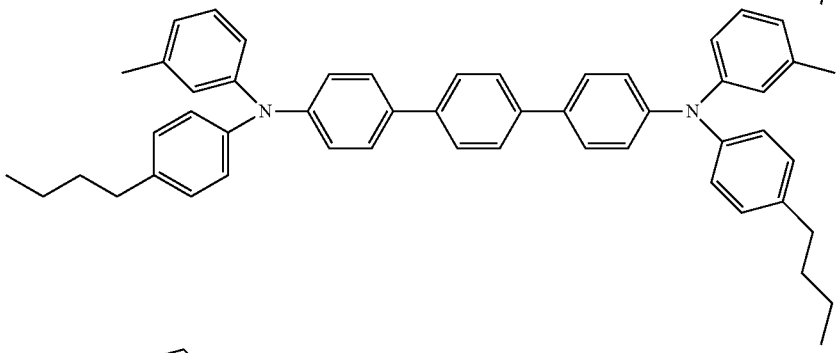

and

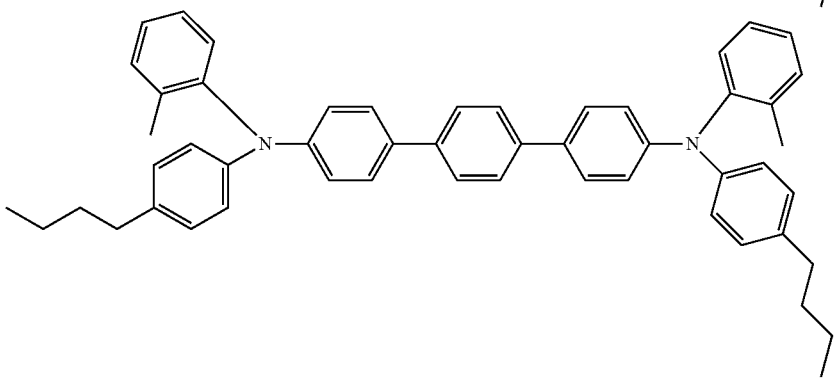

The following Examples are being submitted to illustrate embodiments of the present disclosure. Molecular weights were determined by Gel Permeation analysis.

Comparative Example 1

On a 30 millimeter aluminum drum substrate, an undercoat layer was prepared and deposited thereon as follows. Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting solution was then coated by a dip coater on the above aluminum drum substrate, and the coating solution layer was preheated at 59° C. for 13 minutes, humidified at 58° C. (dew point=54° C.) for 17 minutes, and dried at 135° C. for 8 minutes. The thickness of the resulting undercoat layer was approximately 1.3 microns.

A photogenerating layer, 0.2 micron in thickness, comprising chlorogallium phthalocyanine (Type C) was deposited on the above undercoat layer. The photogenerating layer coating dispersion was prepared as follows. 2.7 Grams of chlorogallium phthalocyanine (ClGaPc) Type C pigment were mixed with 2.3 grams of the polymeric binder (carboxyl-modified vinyl copolymer, VMCH, available from Dow Chemical Company), 15 grams of n-butyl acetate, and 30 grams of xylene. The resulting mixture was mixed in an Attritor mill with about 200 grams of 1 millimeter Hi-Bea borosilicate glass beads for about 3 hours. The dispersion mixture obtained was then filtered through a 20 micron Nylon cloth filter, and the solids content of the dispersion was diluted to about 6 weight percent.

Subsequently, a 32 micron charge transport layer was coated on top of the photogenerating layer from a solution prepared by dissolving N,N'-diphenyl-N,N-bis(3-methylphenyl)-1,1'-biphenyl-4,4'-diamine (mTBD, 4 grams), and a film forming polymer binder PCZ-400 [poly(4,4'-cyclohexylidinediphenylene)carbonate, $M_w$=40,000] available from Mitsubishi Gas Chemical Company, Ltd. (6 grams) in a solvent mixture of 21 grams of tetrahydrofuran (THF) and 9 grams of toluene. The charge transport layer, which was dried for 40 minutes at 140° C., was comprised of PCZ-400/mTBD in a ratio of 60/40.

Comparative Example 2

A photoconductor was prepared by repeating the process of Comparative Example 1 except that a 32 micron charge transport layer was coated on top of the photogenerating layer from a dispersion prepared from N,N'-diphenyl-N,N-bis(3-methylphenyl)-1,1'-biphenyl-4,4'-diamine (4 grams), a film forming polymer binder PCZ-400 [poly(4,4'-cyclohexylidinediphenylene)carbonate, $M_w$=40,000] available from Mitsubishi Gas Chemical Company, Ltd. (6 grams), and polytetrafluoroethylene, PTFE POLYFLON™ L-2 microparticle (1 gram) available from Daikin Industries dissolved/dispersed in a solvent mixture of 21 grams of tetrahydrofuran (THF), and 9 grams of toluene via a CAVIPRO™ 300 nanomizer (Five Star Technology, Cleveland, Ohio). The charge transport layer of PCZ-400/mTBD/PTFE L-2 ratio was 54.5/36.4/9.1, and this layer was dried at about 120° C. for about 40 minutes.

EXAMPLE I

A photoconductor was prepared by repeating the process of Comparative Example 1 except that a 32 micron charge transport layer was coated on top of the photogenerating layer from a solution prepared from N,N'-diphenyl-N,N-bis(3-methylphenyl)-1,1'-biphenyl-4,4'-diamine (4 grams), the film forming polymer binder PCZ-400 [poly(4,4'-cyclohexylidinediphenylene)carbonate, $M_w$=40,000] available from Mitsubishi Gas Chemical Company, Ltd. (6 grams), and the polyamideimide VYLOMAX® HR-15ET ($M_w$=10,000 and $T_g$=260° C.), available from Toyobo America Inc. (0.2 gram), in a solvent mixture of 21 grams of tetrahydrofuran (THF), and 9 grams of toluene. The charge transport layer of PCZ-400/mTBD/VYLOMAX® HR-15ET ratio was 58.8/39.2/2, and this layer was dried at about 120° C. for about 40 minutes.

EXAMPLE II

A number of photoconductors are prepared by repeating the process of Example I except that there is added to the charge transport layer 4 weight percent of the polyamideimide VYLOMAX® HR-11NN ($M_w$=45,000 and $T_g$=300° C.), HR-12N2 ($M_w$=8,000 and $T_g$=255° C.), HR-13NX ($M_w$=10,000 and $T_g$=280° C.), or HR-16NN ($M_w$=100,000 and $T_g$=320° C.), all available from Toyobo America, Inc.

Electrical Property Testing

The above prepared three photoconductors of Comparative Examples 1 and 2, and Example I were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The above photoconductors were tested at surface potentials of 700 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

Almost identical PIDCs were obtained for the above three photoconductors. Therefore, the incorporation of the above polyamideimide into the charge transport layer did not adversely affect the electrical properties of these photoconductors.

Wear Testing

Wear tests of the above three photoconductors of Comparative Examples 1 and 2, and Example I were performed using a FX469 (Fuji Xerox) wear fixture. The total thickness of each photoconductor was measured via Permascope before each wear test was initiated. Then the photoconductors were separately placed into the wear fixture for 50 kilocycles. The total photoconductor thickness was measured again, and the difference in thickness was used to calculate wear rate (nanometers/kilocycle) of the photoconductor. The smaller the wear rate, the more wear resistant was the photoconductor. The wear rate data are summarized in Table 1.

TABLE 1

| | Wear Rate (Nanometers/Kilocycle) |
|---|---|
| Comparative Example 1 (No Additive in CTL) | 60 |
| Comparative Example 2 (9.1% of PTFE in CTL) | 31 |
| Example I (2% of the Polyamideimide in CTL) | 34 |

Incorporation of the polyamideimide into the charge transport layer reduced the wear rate by about 40 percent (34 nanometers/kilocycle for the Example I photoconductor versus 60 nanometers/kilocycle for the Comparative Example 1 photoconductor).

When compared with the Comparative Example 2 PTFE containing photoconductor, the Example I polyamideimide photoconductor exhibited comparable wear rate to that of the PTFE photoconductor (34 nanometers/kilocycle for the Example I photoconductor versus 31 nanometers/kilocycle for the Comparative Example 2 photoconductor). An advantage of incorporating the polyamideimide into the charge transport layer is that it was soluble in the charge transport layer coating solution; whereas PTFE was very difficult to disperse (to disperse used a polymeric dispersant and high energy milling), and the dispersion stability was usually poor, that is the dispersion remained stable for only two months when it began to degrade, regarding the properties, particle size, and components of the dispersion.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a substrate, a photogenerating layer, and a charge transport layer, and wherein said charge transport layer contains a polyamideimide as represented by

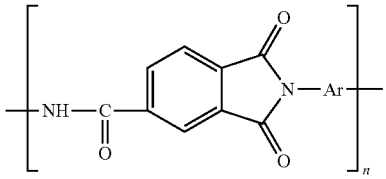

wherein Ar is aryl, and wherein n is a number of from about 20 to about 1,000.

2. A photoconductor in accordance with claim 1 wherein said aryl contains from 6 to about 42 carbon atoms, and n is a number of from about 40 to about 750.

3. A photoconductor in accordance with claim 1 wherein said aryl contains from 6 to about 24 carbon atoms, and n is a number of from about 40 to about 750.

4. A photoconductor in accordance with claim 1 wherein said aryl contains from 6 to about 12 carbon atoms.

5. A photoconductor in accordance with claim 1 wherein said charge transport layer is comprised of a first charge transport layer in contact with said photogenerating layer, and a second charge transport layer in contact with said first charge transport layer, and wherein said polyamideimide is present in at least one of said first and said second charge transport layers.

6. A photoconductor in accordance with claim 1 wherein said polyamideimide is present in an amount of from about 0.1 to about 30 weight percent.

7. A photoconductor in accordance with claim 1 wherein said polyamideimide is present in an amount of from about 1 to about 20 weight percent.

8. A photoconductor in accordance with claim 1 wherein said polyamideimide is present in an amount of from about 2 to about 8 weight percent.

9. A photoconductor in accordance with claim 1 wherein said charge transport layer is comprised of at least one of

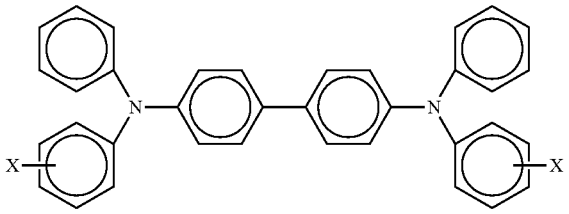

-continued

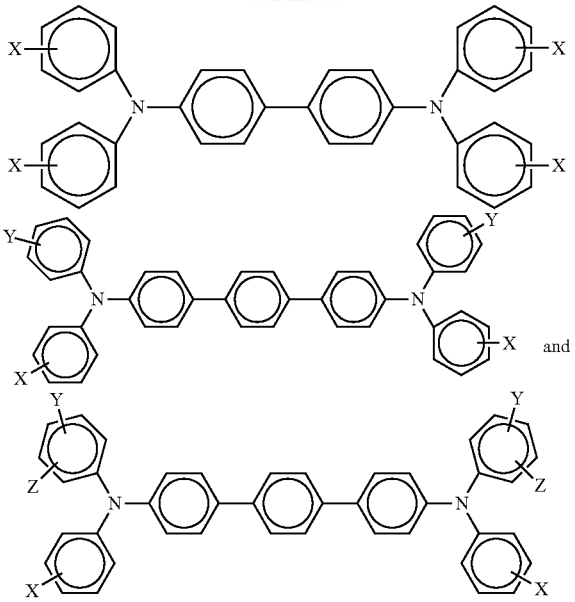

and wherein X, Y, and Z are independently selected from the group consisting of alkyl, alkoxy, aryl, halogen, and mixtures thereof.

10. A photoconductor in accordance with claim 9 wherein said charge transport layer is comprised of a component selected from the group consisting of N,N'-bis(methylphenyl)-1,1-biphenyl-4,4'-diamine, tetra-p-tolyl-biphenyl-4,4'-diamine,N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

11. A photoconductor in accordance with claim 1 wherein said photogenerating layer is comprised of at least one photogenerating pigment.

12. A photoconductor in accordance with claim 11 wherein said photogenerating pigment is comprised of at least one of a titanyl phthalocyanine, a hydroxygallium phthalocyanine, a halogallium phthalocyanine, a bisperylene, and mixtures thereof.

13. A photoconductor in accordance with claim 1 wherein said charge transport layer is comprised of a charge transport component and a resin binder, and wherein said photogenerating layer is comprised of at least one photogenerating pigment and a resin binder; and wherein said photogenerating layer is situated between said substrate and said charge transport layer.

14. A photoconductor in accordance with claim 1 further including in said charge transport layer an antioxidant comprised of at least one of a hindered phenolic and a hindered amine.

15. A photoconductor in accordance with claim 1 further including a hole blocking layer, and an adhesive layer.

16. A photoconductor in accordance with claim 1 wherein Ar is phenyl, benzyl, biphenyl or anthryl, and n represents a number of from about 40 to about 500.

17. A photoconductor in accordance with claim 1 wherein said polyamideimide is represented by and wherein n represents the number of repeating segments and is a number of between about 40 and about 500

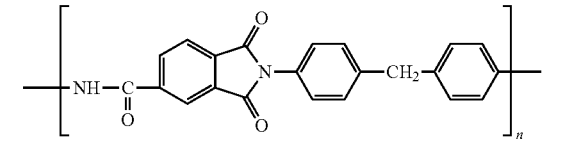

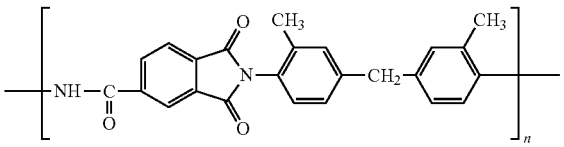

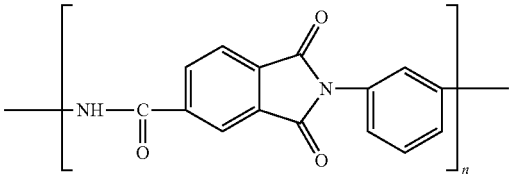

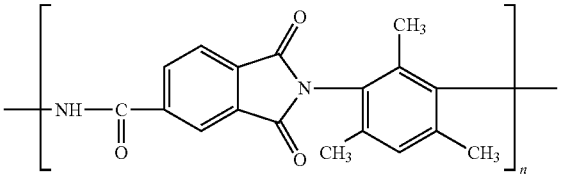

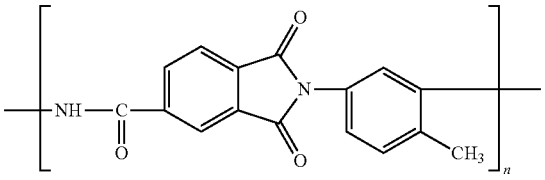

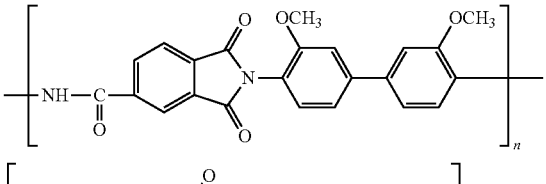

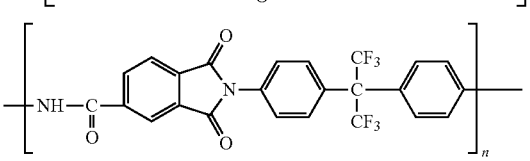

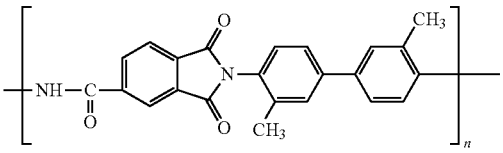

or

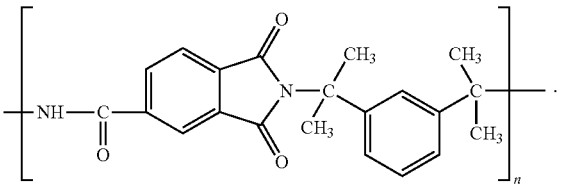

18. A photoconductor comprising a substrate, a photogenerating layer, and a charge transport layer, and wherein said charge transport layer contains a polyamideimide, and wherein said polyamideimide possesses a weight average molecular weight of from about 5,000 to 200,000, and a number average molecular weight of from about 2,000 to about 40,000.

19. with claim 18 wherein said polyamideimide possesses a weight average molecular weight of from about 10,000 to about 100,000, and a number average molecular weight of from about 4,000 to about 20,000.

20. A photoconductor in accordance with claim 18 wherein said polyamideimide possesses a glass transition temperature of from about 200° C. to about 400° C.

21. A photoconductor in accordance with claim 18 wherein said polyamideimide possesses a glass transition temperature of from about 220° C. to about 350° C.

22. A photoconductor comprising a substrate, an optional undercoat layer thereover, a photogenerating layer, and at least charge transport layer, and wherein said charge transport layer is in contact with said photogenerating layer and which at least one charge transport layer contains a polyamideimide present in an amount of from about 0.1 to about 25 weight percent, and wherein at least one charge transport layer is 1, 2, or 3 layers, and wherein said polyamideimide is represented by

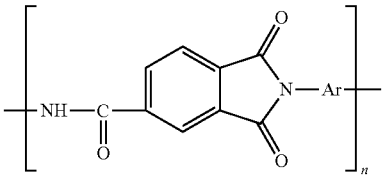

wherein Ar is aryl, and wherein n is a number of from about 20 to about 1,000.

23. A photoconductor in accordance with claim 22 wherein said undercoat layer is present, and is comprised of an aminosilane of at least one of 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris (ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino) ethylamino]-3-proprionate, (N,N'-dimethyl 3-amino)propyl triethoxysilane, N,N-dimethylaminophenyl triethoxysilane, trimethoxysilyl propyldiethylene triamine, and mixtures thereof.

24. A photoconductor in accordance with claim 22 wherein said undercoat layer is comprised of an aminosilane represented by

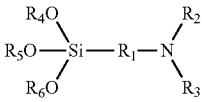

wherein $R_1$ is an alkylene; $R_2$ and $R_3$ are alkyl, hydrogen, or aryl, and each $R_4$, $R_5$ and $R_6$ is alkyl.

25. A photoconductor in accordance with claim 22 wherein said polyamideimide is present in an amount of from about 0.2 to about 17 weight percent.

26. A photoconductor in accordance with claim 22 wherein said polyamideimide is present in an amount of from about 2 to about 10 weight percent.

27. A photoconductor comprised in sequence of a photogenerating layer comprised of a photogenerating pigment and a charge transport layer, and wherein said charge transport layer is comprised of a charge transport component and a polyamideimide present in an amount of from about 0.1 to about 25 weight percent, and wherein said polyamideimide is represented by

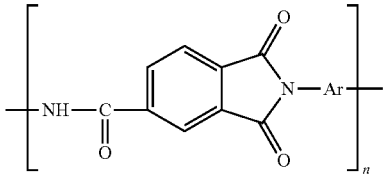

wherein Ar is aryl with from 6 to about 36 carbon atoms, and n represents the number of repeating units and is a number of from about 20 to about 1,000.

28. A photoconductor in accordance with claim 27 wherein said amount is from about 2 to about 10 weight percent.

29. A photoconductor in accordance with claim 27 wherein said aryl contains from 6 to about 18 carbon atoms.

30. A photoconductor in accordance with claim 27 wherein said Ar is phenyl, benzyl, biphenyl or anthryl.

31. A photoconductor comprising a substrate, a photogenerating laver, and a charge transport layer, and wherein said charge transport layer contains a polyamideimide and wherein said polyamideimide is represented by

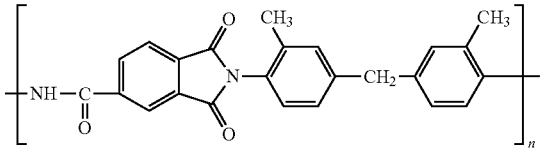

or

-continued

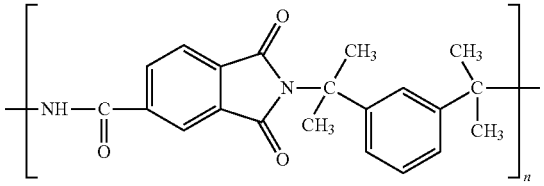

and wherein n represents a number of from about 40 to about 500.

32. A photoconductor in accordance with claim 31 further including a silicone containing polyamideimide.

33. A photoconductor in accordance with claim 32 wherein said silicone containing polyamideimide is represented by

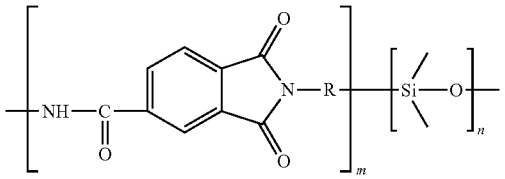

wherein R is alkyl, aryl, or mixtures thereof; m and n represent the number of segments, and where the sum of m plus n is from about 10 to about 1.000.

34. A photoconductor in accordance with claim 33 wherein m is from about 5 to about 500, n is from about 2 to about 500, the number average molecular weight of said silicone containing polyamideimide is from about 3,000 to about 50,000, the weight average molecular weight of said silicone containing polyamideimide is from about 1,000 to about 20,000, R is alkyl with from 1 to about 6 carbon atoms, and said silicone containing polyamideimide has a glass transition temperature of from about 255° C. to about 325° C.

* * * * *